US005361411A

United States Patent [19]

Bohn et al.

[11] Patent Number: 5,361,411

[45] Date of Patent: Nov. 8, 1994

[54] GARMENT FOR THE PROTECTION OF A HEALTH CARE WORKER

[76] Inventors: William W. Bohn, 6720 Willow La., Mission Hills, Kans. 66208; Susan M. Koppe, 628 E. 74th St., Kansas City, Mo. 64131

[21] Appl. No.: 857,922

[22] Filed: May 8, 1992

[51] Int. Cl.[5] ..... A41D 1/00; A41D 10/00

[52] U.S. Cl. ..... 2/69; 2/46; 2/105; 2/114

[58] Field of Search ..... 2/61, 69, 69.5, 75, 2/79, 80, 78.2, 78.3, 78.4, 81, 82, 83, 84, 85, 114, 239, 269, 408, 409, 105, 106; 36/9 R, 110, 7.6

[56] References Cited

U.S. PATENT DOCUMENTS

| | | | |
|---|---|---|---|
| Re. 33,966 | 6/1992 | Robison | 2/82 |
| 1,157,265 | 10/1915 | Tutelman | 2/269 |
| 1,564,874 | 12/1925 | Madden | 2/61 X |
| 2,413,826 | 1/1947 | Hayes | 2/75 X |
| 2,630,636 | 3/1953 | Cockrell | 36/9 R |
| 2,679,647 | 6/1954 | Gossner | 2/82 |
| 2,779,331 | 1/1957 | Trexler | 2/82 X |
| 2,981,954 | 5/1961 | Garbellano | 2/81 X |
| 3,016,631 | 1/1962 | Servin | 36/9 R |
| 3,279,469 | 10/1966 | Schustack | 2/408 X |
| 3,361,132 | 1/1968 | Rentsch, Jr. | 2/69 X |
| 3,487,830 | 1/1970 | Pruett | 2/239 |
| 4,651,354 | 3/1987 | Petrey | 2/239 |
| 4,825,564 | 5/1989 | Sorce | 36/9 R X |
| 4,951,321 | 8/1990 | Mortensen et al. | 2/408 |

*Primary Examiner*—Jeanette E. Chapman

*Attorney, Agent, or Firm*—Hovey, Williams, Timmons & Collins

[57] ABSTRACT

A garment for protecting health care workers in environments of exposure to potentially contaminated fluids includes a tubular sheath having a pair of adhesive strips angularly oriented thereon for conforming the sheath to a leg and foot of the worker. The free ends of one strip are provided with an adhesive surface whereby the sheath may easily be conformed for a variety of different sizes of workers. The garment is preferably provided as a one-piece trouser for convenience of wearing, whereby the feet and legs of the worker are protected from contamination.

7 Claims, 4 Drawing Sheets

GARMENT FOR THE PROTECTION OF A HEALTH CARE WORKER

BACKGROUND OF THE INVENTION

1. Field of the Invention

The present invention is broadly concerned with an improved garment for the protection of a health care worker against potentially contaminated fluids such as blood and the like. More particularly, it is concerned with a liquid-impervious garment including a tubular sheath of flexible, fluid-impermeable material provided with a strip attached thereto for conforming a portion of the sheath around the foot of a health care worker on which it is worn.

2. Description of the Prior Art

Operating room personnel are required to work in an environment which subjects them to exposure to the bodily fluids of the patient. In particular, surgeons and surgical nurses must work in close proximity to patients which may have blood, lymph fluid or other bodily fluids which are potentially contaminated with diseases such as hepatitis or acquired immune deficiency syndrome. Such diseases may be career-ending or even fatal if contracted by the health care worker. Accordingly, there has been developed a need for a garment which will adequately protect the physician, nurse or orderly working in the operating room from contact with these potentially contaminated fluids. This is especially the case in regard to protective garments to be worn around the health care worker's feet and ankles, as standing fluids may accumulate during the course of an operation which may result in virtually continuous contact between the health care worker's feet or shoes and the bodily fluids which accumulate on the surface of the operating theater.

In the past, shoe covers have been developed for use by workers which must protect themselves from contamination or protect the surrounding environment from contamination carried into the area by the individual. For example, shoe covers have been developed for use in the electronics-assembly clean rooms which are also used by health care workers. One example of such a shoe cover is that marketed by the American Hospital Supply Corporation as Micro-Clean 2-1-1-2 high-top shoe cover, sold under catalog number 69225.

While the shoe covers have been useful in electronics-assembly clean rooms and other environments not subjected to a large volume of fluids, health care workers who must stand in pools of accumulated body fluids during the course of a surgical operation have recognized leakage by the shoe cover around the sole portion where the fabric attaches to a synthetic resin plastic sole. Leakage also occurs through the fabric during saturation by liquids. Fully water-proof or liquid-impermeable shoe covers have proven too expensive to be disposable and too bulky for storage and proper size-ranging availability.

Yet further, the shoe covers often have a slick bottom sole which is particularly troublesome in an operating room environment where large pools of fluid may accumulate on the floor making traction difficult. Yet further, it has been found that where the garment is fully fluid-impervious, the wearer may become uncomfortable because of the weight of the material and the lack of ventilation in the garment. For this reason, garments of particularly heavy fabric are unsuitable for use in the operating room, while on the other hand, extremely thin materials are subject to tearing which defeats the entire purpose of the garment.

In addition, a desirable health care worker garment must be inexpensive and disposable to avoid the possibility of contamination to subsequent patients in successive operations. A desirable garment must fold compactly for storage until the time of use and must also protect substantially the entire lower half of the health care worker's body, i.e. from the toes to the chest. It must remain relatively light in weight, flexible and sufficiently inexpensive to construct so as to be disposable. The shoe covers of the prior art have failed to provide adequate protection to the legs of the health care worker and have not been provided in a unitary, single garment which may be easily packaged, donned and thereafter disposed.

SUMMARY OF THE INVENTION

These problems are in large measure solved by the protective garment of the present invention. The garment hereof provides a protective sheath around the wearer's foot, ankle and lower leg and may be provided in the preferred embodiment which includes a one piece garment extending around each foot and past the waist to provide enhanced protection against contact between the wearer and contaminated fluid which may be encountered in the operating room environment. The garment is preferably in the form of a tubular sheath of flexible, fluid-impermeable synthetic resin material which may be drawn up around each of the wearer's feet and legs and supported by a pair of over-the-shoulder straps to protect the wearer's torso.

In one embodiment of the invention, the garment is in the form of a tubular sheath of a flexible, fluid-impermeable material which may be snugly conformed to any size or shape of a foot and ankle by the use of an angularly oriented, optionally adhesively attached strip extending outwardly from the sole portion of the garment. A pair of strips may be provided, whereby one of the strips is oriented in an axial direction in order to provide a slip-resistant sole surface, while a second strip is oriented transversely to the first strip and attached to the sheath at the sole portion to permit wrapping of the second strip around the wearer's instep and ankle. Alternatively, the transversely oriented strip may by tied instead of adhesively attached. This garment advantageously may include a circumferentially extending elastic band coupled to the garment for biasing the sheath inwardly against the wearer's leg.

Alternatively, in a second embodiment, the garment hereof may be provided as a unitary member encompassing two tubular sheaths joined together to provide a open top end and to present a trouser-like garment. The garment may be maintained in position in a variety of ways, such as by an elastic band or drawstring extended around the wearer's chest, or suspended by straps extending over the wearer's shoulders. An open area may be provided in the region of the wearer's crotch in order to provide some measure of ventilation and ease of movement between sitting and standing positions during extended surgical sessions. A removable apron member may be provided to cover the open region to protect it from exposure to the bodily fluids of the patient.

In a further embodiment, the garment presents a pair of tubular sheaths to receive the feet and legs of the wearer and a torso portion which extends upwardly from the leg portions. The garment is open at the top to enable access to the wearer, and a pair of shoulder straps are secured to the back thereof and pass through laterally spaced slits at the front of the garment. The wearer may thus pull on the portion of the straps which extend through the slits to pull the garment up around his or her chest. In addition, by securing the straps together by tying or the like, the wearer also tightens the garment around his or her chest or waist to provide greater conformity to the body and thus less chance of accident in the operating room, as well as greater protection against contaminated fluids entering through the top. This garment also advantageously includes a transversely oriented strap which extends under the sole and may be wrapped around the ankle of the wearer for greater conformity to the wearer's foot, as described hereinabove.

In particularly preferred embodiments, this garment is provided with a means of adjusting the length of the leg portions for the individual wearer, such as snaps, buttons or hook and pile fabric fasteners. By orienting these fasteners vertically along the inseam or elsewhere along the leg portions, the length of the leg portions may be adjusted so that only one size of protective garment need be manufactured which may then be adjusted to fit the vast majority of wearers. This latter feature is especially important to hospitals inasmuch as they would thus need to carry only a single item for these garments in inventory to fit the vast majority of their operating room staff.

A further version of this invention is advantageously provided which presents a pair of tubular sheaths to receive the feet and legs of the wearer therewithin and which are joined together to present a pants-like garment which extends upwardly to the wearer's torso. This garment is open at the top to enable access by the wearer and remains substantially open during use. That is to say, the garment hereof remains loose fitting and enables air to circulate through the garment during long periods of use. It also has been found that a garment in accordance with the present invention must be relatively thin yet strong enough to withstand the rigors of the operating room environment while remaining comfortable to wear for several hours. In this regard, it has been determined that the preferred garment in accordance with the present invention is provided from a material which is preferably 1.5 to 8 mil. in thickness and preferably about 4 mil. in thickness. The sole portion of the garment is additionally reinforced by a second layer of the material which is preferably polyvinyl chloride sheathing. The top margin of the garment is preferably sewn or heat sealed in order to attached-elastic straps which ensure the garment to drape successfully over the shoulders of the health care worker.

The garment constructed in accordance with the present invention may be successfully dispensed from a box and thus multiple packaging of the disposable garments is provided. By providing elastic straps for supporting the garment over the shoulders of the wearer, and by providing the transversely oriented strips beneath the sole for conforming the sheaths around the wearer's feet and ankles, the garment hereof can be successfully manufactured in a "one size fits all" configuration, with the straps and strips adapting the garment hereof to differently sized wearers.

DESCRIPTION OF THE PREFERRED EMBODIMENT

Figure 1:
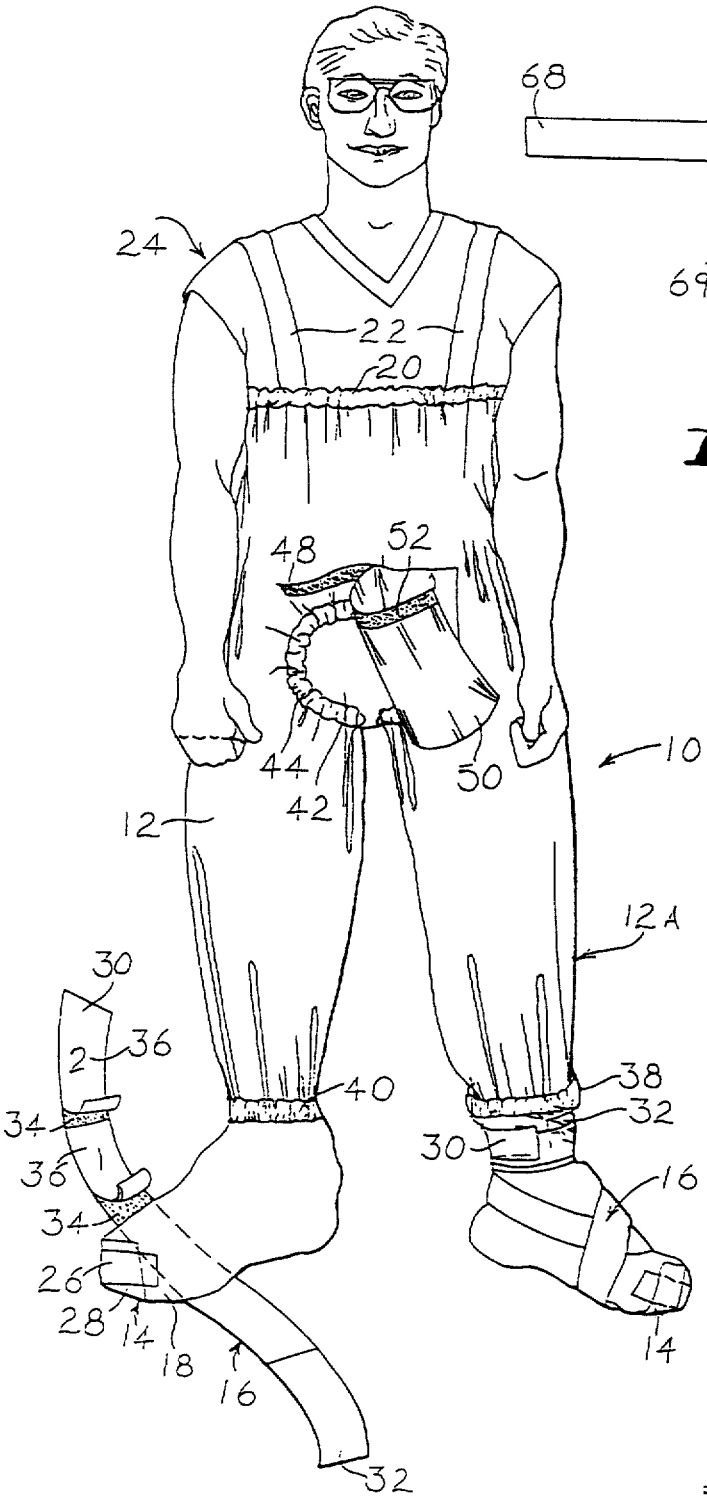
FIG. 1 is a front view of one embodiment of the protective garment hereof, showing it worn by a health care worker and disclosing a unitary, trouser-like tubular sheath structure with the right foot of the wearer shown prior to conformance of the sheath by a transversely extending strip, while the left foot is shown in a final, wrapped position, and also showing the apron member for positioning over the open crotch area.

Referring now to the drawings, a protective garment intended for wear by health care workers is shown in FIG. 1 and broadly includes a tubular sheath 12 of substantially fluid-impermeable material and a pair of strips 14 and 16 for conforming the sheath 12 to the foot and ankle of the wearer.

First strip 14 extends axially in a direction generally from the enclosed toe-surrounding portion 18 of sheath 12, toward but not all the way to, open end 20 of the sheath 12 for reinforcing the sole portion of said sheath. Second angularly oriented strip 16 extends substantially transversely to first strip 14, each of the strips 14 and 16 being attached to the sheath 12 by the adhesive portion of the strip at a location corresponding to the bottom or sole portion of the sheath 12. The protective garment 10 is supported by suspenders 22 extending from the front of the garment 10 to the back thereof and adapted to be draped over the shoulders of the health care worker 24 on which the garment is worn.

In somewhat greater detail, first strip 14 is approximately 5½ inches in width and extends a total length of approximately 24 inches. Such length of the strip 14 is sufficient to accommodate virtually all sizes of shoes which might be worn by the health care worker 24 while the width provides an adequate sole defining dimension which effectively reinforces the sheath along the portion engaging the floor. The strips are preferably made of an adhesive-backed polyethylene film such as that manufactured and supplied by Edison Plastic, the strips being approximately 1.5 ml. in thickness. In order to provide a scuff and wear resistant toe receiving region, the first strip 14 wraps around the forward end of the enclosed toe surrounding portion 18 and provided with an axially or generally lengthwise cut along its last approximately 5 inches in order that a first toe-covering section 28. A skid resistant coating may be provided along the bottom of first strip 14 as best seen in the embodiment shown in FIG. 2.

Second, transversely oriented strip 16 may be located either between first strip 14 and sheath 12 or over first strip 14 and is oriented angularly thereto in order to extend substantially transversely from the orientation of first strip 14. However, if first strip 14 is provided with a slip-resistant coating, second strip 16 is preferably positioned between first strip 14 and sheath 12 at its center portion. Second strip 16 is also preferably made of synthetic resin material, such as an adhesive-backed polyethylene film of 1.5 ml. thickness manufactured by Edison Plastic. Second strip 16 is provided with a portion which adheres directly to either the first strip 14 or the sheath 12, while also including first free end 30 and second free end 32. The total length of second strip 16 is approximately 50 inches and the preferred width of second strip 16 is approximately 3 inches. These dimensions enable the first and second free ends 30 and 32 respectively to wrap around the health care worker's foot in order to conform the sheath 12 to the foot (including the shoe) of the wearer and the wearer's ankle. Preferably, the free ends are provided with an adhesive 34 on one side thereof which is covered by one or more removable, adhesive-resistant cover 36 for ease of use and preventing the adhesive from attaching prematurely to the sheath during storage or dressing.

As shown in FIG. 1, the protective garment 10 is provided with circumferentially extending gathered portion 38 having an elastic member carried therewithin. The elastic member 40 is oriented in a circumferential direction around sheath 12 intermediate enclosed toe-surrounding portion 18 and open end 20 for biasing the sheath 12 inwardly against the leg of the health care worker 24. The sheath 12 is substantially tubular in shape from enclosed end 18 where it is provided with a rounded, enclosed toe portion opposite open end 20. In the embodiment of the protective garment 10 shown in FIG. 1, two sheaths 12 and 12A are joined together to form a trouser-like protective garment 10 capable of protecting the health care worker's 24 legs and feet.

In the garment shown in FIG. 1, an open area 42 is defined at the junction of the sheaths 12 and 12A in an area adjacent the health care worker's 24 crotch. The area is defined by a second gathered portion 43 having an elastic member 44 therewithin for resiliently biasing the open area against the wearer's torso. The open area is designed to enable the wearer 24 to stand up or sit down in comfort without the necessity of adjusting the garment 10 with his or her hands, which would ordinarily be covered with sterile gloves. The opening may extend between the wearer's legs around to a portion of the buttocks area, so that the garment 10 may readily adjust to a variety of different positions whether the health care worker may be seated on a stool during an extended surgical operation or walking about the operating area. Immediately above the open area, a tape 48 of hook and pile fabric which is sewn or adhesively applied to the sheath 12. Hook and pile fabric tape 48 is adapted to receive an apron 50 for covering the open area 42 and thus protecting it against contamination by bodily fluids of the patient. A mating hook and pile fabric strip 52 is attached by adhesive or sewing to the apron 50 for cooperation with tape 48 so that apron 50 may be easily attached and removed, as desired. Alternatively, apron 50 may be permanently attached to the garment for ease of manufacturing.

A variety of different materials may be employed in the construction of sheath 12, but it has been determined that two preferably materials are polyethylene sheets of 1 to 3, and preferably 1.5 mil. thickness, and also Kraton Elastomer manufactured by Dow Chemical Co. Such material would also be used for the apron 50.

If, because of manufacturing considerations, the sheaths 12 and 12A must be formed such that a seam is necessary, the seam should be heat sealed or treated with a waterproof coating so that no liquid will seep through any seam during immersion in a fluid. Preferably, the sheaths 12 will be formed without seams so that any possibility of leakage is minimized.

Figure 2:
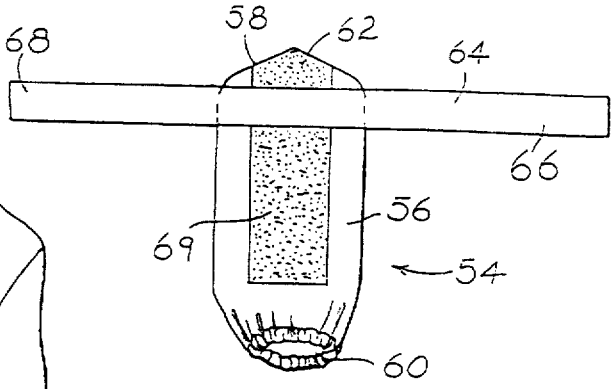
FIG. 2 is a bottom view of an alternate embodiment of the present invention, showing the angularly oriented strips extending along the bottom of the tubular sheath and the circumferentially oriented elastic member.

Turning now to FIG. 2, an alternate embodiment of the protective garment 54 is provided as separate sheaths each corresponding to one ankle and foot of the health care worker 24. In a case of protective garment 54 as shown in FIG. 2, the sheath 56 is somewhat abbreviated relative to sheath 12 as shown in FIG. 1, so that sheath 56 extends from an enclosed toe-surrounding portion 58 to an open end 60 and extends substantially a length from the wearer's toe to above the ankle.

As in the embodiment shown in FIG. 1, a first strip 62 extends at an axial direction from the enclosed portion 58 to the open portion 60, while a second strip 64 is oriented angularly thereto to extend transversely across the sheath 56. First strip 62 and second strip 64 are dimensioned as in the embodiment shown in FIG. 1, with strip 64 including free ends 66 and 68 and having adhesive portion attached to the sheath 56 intermediate free ends 66 and 68. The sheath 56 is made of the same material as sheath 12, while the strips 62 and 64 are preferably adhesive-backed polyethylene strips. The bottom or sole portion of the strip 62 may be provided with a skid or slip resistant coating 69 of pebbled rubber or rubber strips, but the polyethylene tape itself is reasonably slip-resistant in most surgical environments.

Figure 3:
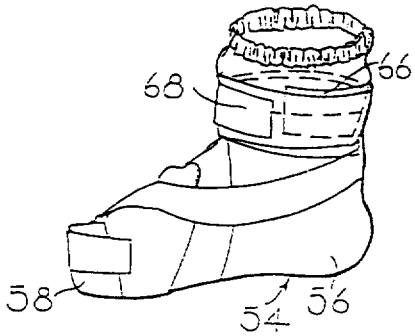
FIG. 3 is an enlarged perspective view of the embodiment shown in FIG. 2, illustrating the positioning of the adhesive-backed strips around the sheath for conforming the sheath to the wearer's foot, ankle and leg.

Turning now to FIG. 3, the strips are preferably oriented for positioning, at least initially, along the sole of the wearer's shoe or foot, whereby strips 62 and 64 form a skid-resistant sole which reinforces the sheath 12 against ripping or tearing, as well as providing a surface which resists skidding along ceramic or linoleum time when exposed to liquids. In practice, the wearer dons a protective garment 10 or 54 by inserting his or her feet into the tubular sheath 12 or 56 until the worker's shoe or foot engages the reinforced enclosed toe-surrounding portion 18 or 58 depending on the particular embodiment. Thereafter, the sheath 56 is drawn up around the worker's foot or ankle, or sheath 12 is drawn up along the leg until open end 20 is around the wearer's waist in the embodiment shown in FIG. 1.

The adhesive resistant covers 36 are then removed from second strip 16 or second strip 64, and the free ends 30 and 32 or 66 and 68 are wrapped in criss-cross fashion across the top of the wearer's foot and around the back of the ankle to provide a tightly conforming "bootie". The free ends 30 and 32 or 66 and 68 are tightly secured to the exterior of the sheath 12 or 56 respectfully by their adhesive backing, presenting a fully protective, fluid-resistant protective garment. In the case of the garment shown in FIG. 1, the worker would then ensure that both sheaths 12 and 12A are properly wrapped and prepared to form a protective garment as demonstrated by the left foot of the worker 24 in FIG. 1. After the suspenders 22 have been placed over the worker's shoulders, the apron 50 may be attached by hook and pile fabric tapes 48 and 52 over open area 42.

After the surgical operation has been completed, the physician may easily remove the garment even with the protective surgical gloves still on, by pulling the free ends 66 and 68 or 30 and 32 from the sheath 56 or 12, loosening the garment 10 or 54 from around his or her foot, and then drawing his or her foot out of the garment. The garment 10 or 54 may then be disposed together with other surgical and medical waste products, and the risk of contamination to the worker is significantly minimized.

Figure 4:
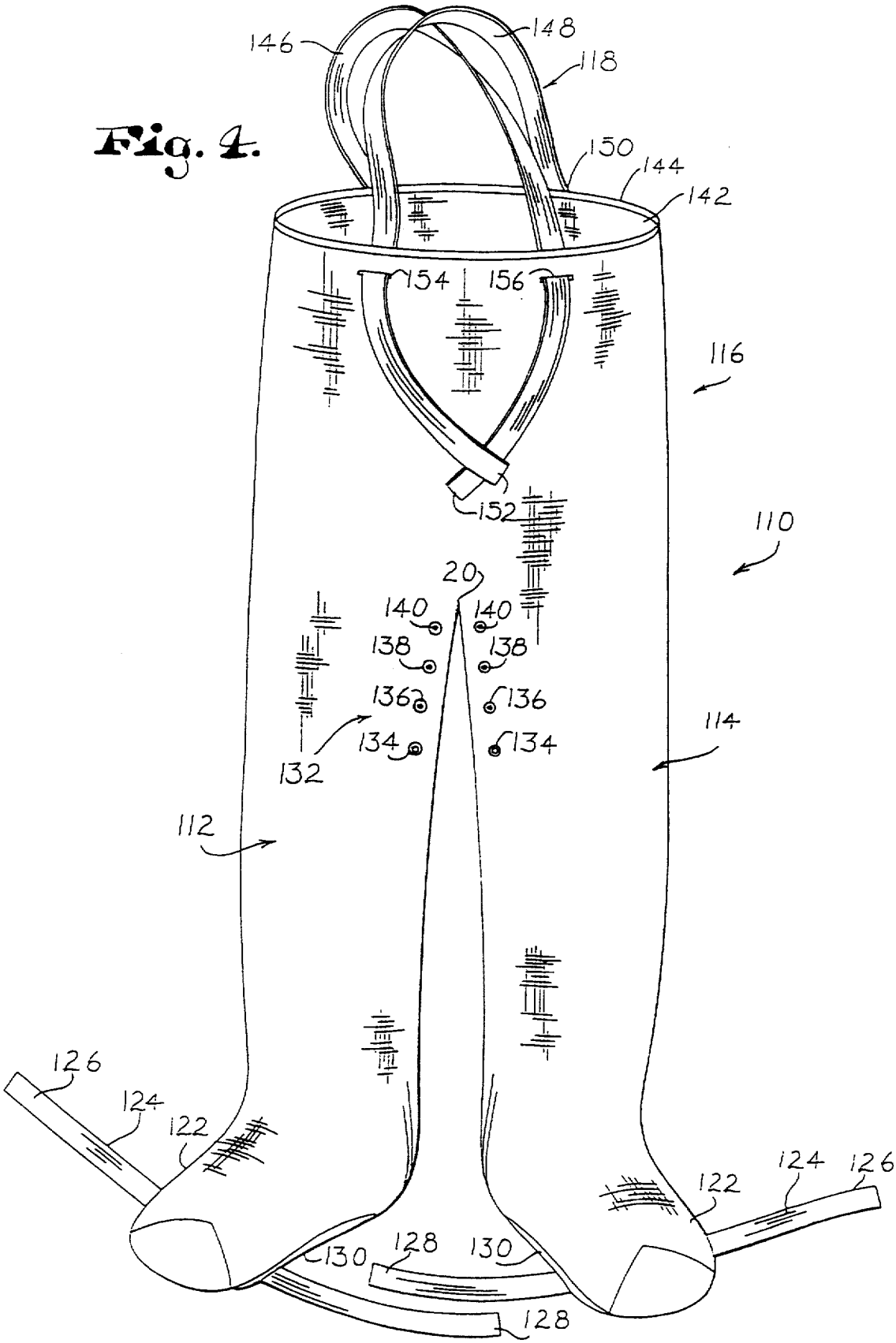
FIG. 4 is a front perspective view of an alternate embodiment of the garment in accordance with the present invention, showing a pair of leg portions and a pair of over-the-shoulder straps for suspending the garment from the shoulders of the wearer, as well as length-adjusting means.

An alternate embodiment of the invention hereof is shown in FIG. 4 and includes a protective garment 110 for wear by a health care worker or the like broadly includes a pair of sheaths comprising leg portions 112 and 114, a torso portion 116 and supporting structure 118. The leg portions 112 and 114 are joined together and with the torso portion 116 at crotch region 20 to present a substantially unitary, fluid-impervious garment. The leg portions and torso portion are preferably made of synthetic resin material such as polyvinyl chloride.

In greater detail, the leg portions 112 and 114 each are enclosed at one end thereof to present a foot-receiving region 122. The leg portions 112 and 114, including the foot-receiving regions 122 thereof, are loose-fitting in order to enable a wearer to easily don the garment with his or her shoes on.

So that the foot-receiving region 122 may conform to the wearer's foot and lessen the possibility of slipping or falling, the garment 110 advantageously includes a conforming strip 124 extending transversely to a line extending from the wearer's heel to the toe. The conforming strip 124 may be secured to the bottom or sole portion of the foot-receiving region 122 preferably by heat sealing the conforming strip 124 thereon, or alternatively by a layer of adhesive between the conforming strip 124 and the sole of the foot-receiving region 122. The conforming strip 124 includes a pair of free ends 126 and 128 which may be tied together after wrapping around the wearer's ankle or they may be provided with an adhesive coating for ease in applying the conforming strips 124. The conforming strips 124 may be of pressure sensitive synthetic resin material such as polyethylene, as is manufactured by Edison Plastic, or more economically from non-adhesive backed polyvinyl chloride which may then be tied together.

The foot-receiving region 122 may also be provided with a reinforcing strip 130 extending longitudinally along the bottom or sole portion from adjacent the heel of the wearer up and over the toe of the wearer to minimize tearing of the sheath. The reinforcing strip 130 is preferably of polyethylene film manufactured by Edison Plastic and may be attached to the foot-receiving region 122 by heat sealing or by use of an adhesive.

Each leg portion 112 and 114 is provided with a length adjustment component 132. As shown in FIG. 4, the length adjustment component 132 includes a male snap 134 complimentary to a series of female receivers 136, 138 and 140. The snap 134 may be attached, as desired, alternately to any of the receivers 136, 138 or 140 to shorten the distance between the foot-receiving region 122 and the crotch region 120. It may be understood that a button could be substituted for the snap 134 and button holes for receivers 136, 138 or 140, or that hook and pile fasteners commonly sold under the trademark VELCRO could be used in place of the snap and receiver to accomplish the same length adjustment function.

The torso portion 116 includes an opening 142 at the top thereof defined by a top margin 144. The opening 142 is sized to enable a wearer to don the garment by placing his or her legs and torso therein. The supporting structure 118 includes a pair of over-the-shoulder straps 146 and 148 which may be of cloth or synthetic resin such as polyvinyl chloride. The back end 150 of the straps 146 and 148 are secured to the rear side of the torso portion 116 proximate the top margin 144 by sewing, heat sealing or adhesive. The free, front end 152 of each strap 146 and 148 is routed through respective laterally spaced-apart slits 154 and 156.

In use, the wearer enters the garment 110 by placing one foot into each of the leg portions 112 and 114 until each foot is fully within the foot-receiving portion 122. The foot-receiving region 122 is loose and "baggy" to allow the wearer to keep his shoes on and to accommodate even large-sized shoes. To keep the material from presenting a safety hazard in use, conforming strip 122 is then wrapped in criss-cross manner over the wearer's instep and around the ankle, whereupon the free ends 126 and 128 may be tied together for holding the loose material against the wearer's foot and ankle. The reinforcing strip 130 reduces tears in the garment's material caused by friction or pulling between the wearer's shoe and the floor, and may be provided with a skid-resistant coating to further limit slips on wet surfaces.

The wearer may then adjust the length of the leg portions 112 and 114 by the use of the length adjustment component 132. Snap 134 may be connected to any one of the receivers 136, 138 or 140 depending on the inseam measurement of the wearer, thus preventing the crotch region 120 from hanging too far down and interfering with normal movement.

The straps 146 and 148 may then be adjusted to enable the torso portion 116 to conform to the particular wearer. For example, the straps may be loosened for a tall person or one with a large girth, or pulled more tightly for a shorter person or one with a small chest or waist. The free end 152 of each strap is then tied together, with the result that the length of the straps 146 and 148 between the respective back end 150 and the slits 154 and 156 corresponds to the torso length of the wearer, and the distance between the slits 154 and 156 corresponds to the girth or chest size of the wearer. By tying the front ends 152 of straps 146 and 148 together, the top margin 144 is drawn around the wearer's chest and the garment 110 is thus able to quickly and simultaneously adjust to both the height and girth of the wearer. The garment 110 may be easily removed by simply untying the straps 146 and 148 and the free ends 126 and 128 of each strip 124 and then slipping out through the opening 142.

Figure 5:
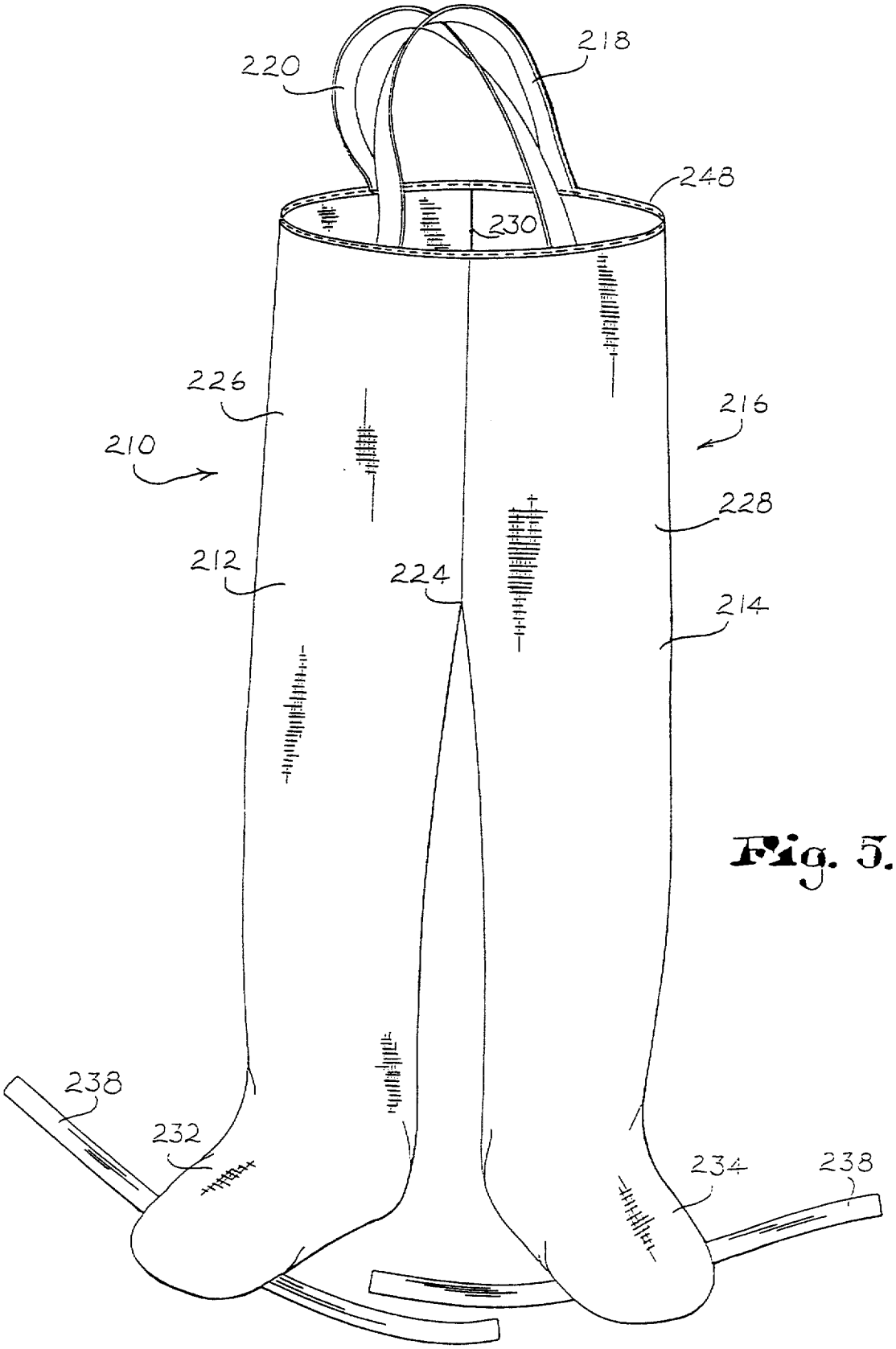
FIG. 5 is a front perspective view of a further alternate embodiment of the garment in accordance with the present invention, showing a pair of leg portions and a pair of over-the-shoulder straps for suspending the garment hereof from the shoulders of the wearer to provide an open top margin.

In a further embodiment of the invention hereof, a protective garment 210 for wear by a health care worker or the like broadly includes a pair of sheaths comprising leg receiving portions 212 and 214, a torso portion 216 and a pair of elastic over-the-shoulder straps 218 and 220 for supporting the garment 210 on a wearer as shown in FIG. 5. The leg-receiving portions 212 and 214 are joined together at crotch region 224 to present a substantially unitary, fluid-impervious garment. The leg portion 212 and the left half 226 of the torso portion are preferably provided of one sheet of synthetic resin material, preferably polyvinyl chloride, while the leg portion 214 and right half 228 of the torso portion 216 are of a second sheet of synthetic resin material. The left half 226 and the right half 228 are joined together by heat sealing, ultrasonic welding or adhesive to provide a fluid impervious intersection 230 essentially bisecting the garment 210 along a fore-and-aft vertical plane.

Figure 6:
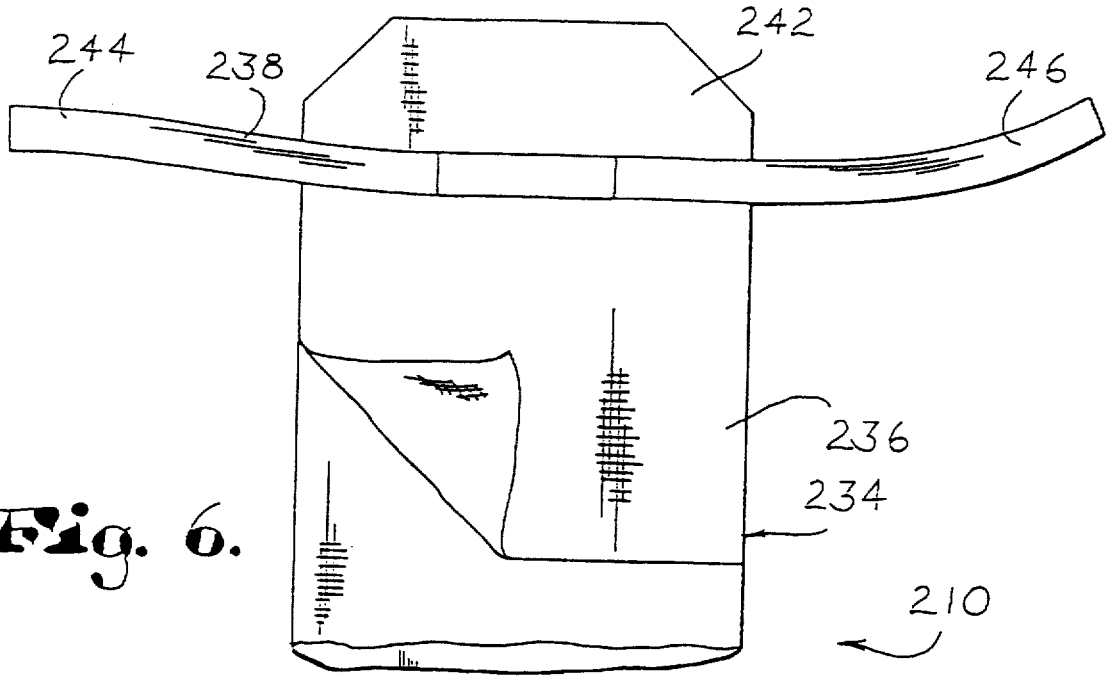
FIG. 6 is a fragmentary bottom plan view of the garment shown in FIG. 5, showing the transversely oriented strip and a portion of the sole reinforcing layer of material released from the underlying layer to show the thickness thereof.

In greater detail, each of the leg portions 212 and 214 are essentially tubular of a constant diameter from the calf region and extending throughout the majority of the foot-receiving portions 232 and 234 as shown in FIGS. 5 and 6 sheaths terminating in foot-receiving portions 232 and 234, respectively. The foot-receiving portions are sized to receive the entire foot and shoe of wearers with even large (size 14 or larger) shoes since the foot-receiving portions are essentially tubular and able to conform to any length. Preferably, the tubular sheaths have a circumference of about 22 inches to accommodate the foot and shoe of the wearer. With the following exception, the material used in the garment including the foot-receiving portions 232 and 234 is preferably 1.5 to 8 mil. thickness polyvinyl chloride, and most preferably 4 mil. thickness. It has been found that 4 mil. thickness polyvinyl chloride material provides the optimum weight for resisting fluid intervention and withstanding wear while at the same time remaining comfortable to wear. Use of a thinner fabric is prone to failure in the operating room environment, while use of thicker material impairs the comfort of the wearer, the flexibility of the garment during use, and the ability of the garment to be compactly folded prior to use.

However, as shown in FIG. 6, each foot-receiving portion 232 and 234 is provided with a reinforced sole 236, which consists of a second layer of preferably polyvinyl chloride fabric over normal thickness of the foot-receiving portions 232 and 234. The additional 1.5 to 8 mil. thickness polyvinyl chloride fabric, and preferably 4 mil. thickness fabric, provides sufficient reinforcement without greatly adding to the overall weight of the garment 210, as the additional layer is confined to an area roughly 11 inches by 16 inches on each foot-receiving portion 232 and 234. In addition, the size of the area of the reinforced sole 236 does not inhibit folding of the garment to a desirably small configuration, as shown in Fig. 7.

A strip 238 is secured to each reinforced sole portion 236 by heat-sealing, adhesive or other means of securement to thereby permanently bond the strip 238 to the sole portion of the respective foot-receiving region 232 or 234 for enabling binding of the garment 210 about the corresponding foot and ankle of the wearer. The strip 238 is also preferably a strip of 1" width polyvinyl chloride material about 4 mils. in thickness and about 60 inches in length. The strip 238 is preferably secured along the midsection 240 thereof to the bottom of the reinforced sole 236 at a location which would normally be forward of the wearer's arch, or about 2 to 4 inches from front margin 242. The strip 238 can be wrapped around the instep of the wearers foot and then around the ankle to conform the foot-receiving portions 232 and 234 around the wearers foot. Alternatively, adhesive could be applied at the free ends 244 and 246 of the strip to adhesively secure a wrapped strip 232 around the instep and ankle of the wearer. The front margin 242 of the foot-receiving portion (which is essentially tubular until closed) is enclosed by a heat sealed, ultrasound, or other imperforate seam to prevent entry of fluids into the garment 210.

The upper margin 248 of the garment 210 is open and not gathered around the torso of the wearer to permit air to circulate as a result of the health care worker's motions. When the garment 210 is worn, the straps 218 and 220 support the upper margin 248 in a position as shwon in FIG. 1 with respect to garment 10, with the upper margin 248 located above the waist but below the armpit, so that the upper margin encircles the nipple area of the wearer. Over the shoulder straps 218 and 220 are bonded to the torso portion 216 by heat sealing, ultrasonic welding or adhesive, or alternatively they may be sewed into the upper margin as shown in FIG. 5. The straps 218 and 220 are preferably 178 inch wide and of elastic material such as Spandex. The straps 218 and 220 are crossed as shown in the FIG. 5 to maintain the garment 210 in position during use.

Figure 7:
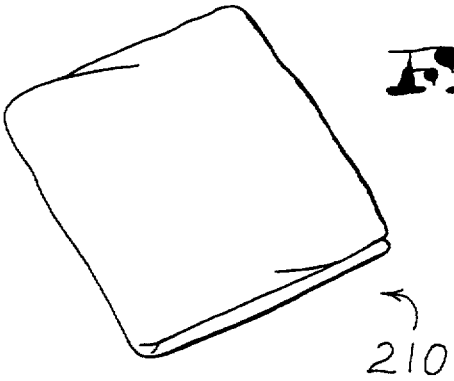
FIG. 7 is a perspective view of the garment of FIGS. 5 and 6 in a folded configuration.

In use, the garment 210 is removed from a box wherein a number of the garments 10 are stored in folded condition as shown in FIG. 7. Thereafter, the garment 10 is unfolded and the health care worker need only slide his or her legs through the upper margin 248 and into leg-receiving portions 212 and 21 4 and place the straps 218 and 220 over his or her shoulders. The health care worker then grasps the free ends 244 and 246 and wraps the strip 238 around the instep and ankles to conform the foot-receiving portions to the wearer's feet, tying the free ends 244 and 246 to prevent the wrap from unraveling. The garment is then ready to use. The garment may be removed after use by reversing the above steps and is readily disposable because of its low mass and low cost.

We claim:

1. A garment for the protection of a wearer thereof and comprising:

a unitary sheath of flexible, substantially fluid-impermeable synthetic resin material having a thickness of from about 1.5–8 mil and presenting an uppermost, tubular, open-top, torso-receiving section and a pair of adjacent depending, tubular leg and foot-receiving sections each presenting a region adjacent a corresponding calf of the wearer and a foot-receiving region, said foot-receiving regions being configured for surrounding the feet and ankles of the wearer and terminating in a closed lowermost end, said leg and foot-receiving sections each having a substantially constant diameter from said calf region and extending throughout a majority of a length of said foot-receiving region, there being an uppermost margin defining an upper end of said open-top torso-receiving section and which is located, when the garment is worn, above the waist but below the armpits of the wearer and encircling the nipple area of the wearer, the open area defined by said uppermost margin being greater than the torso of the wearer, each of said leg and foot-receiving sections being of a length to accommodate each corresponding leg and foot of the wearer with the foot-receiving region of each of the leg and foot receiving sections being substantially wider than the wearer's foot;

strap means permanently bonded to each of said foot-receiving regions for binding each of said foot-receiving regions about a corresponding foot and ankle of the wearer; and suspender means formed of elastic material and secured to said torso-receiving section, said suspender means being oriented for passing over the shoulders of the wearer and resiliently supporting said sheath during movement of the wearer.

2. The garment of claim 1, each of said strap means being continuous and of a length for crossing over the top of the wearer's foot, passing behind the wearer's ankle, and tying thereof at that front of the wearer's ankle.

3. The garment of claim 1, wherein said synthetic resin material is polyvinylchloride.

4. The garment of claim 1, each of said foot-receiving regions having a reinforced sole.

5. The garment of claim 4, said strap means being secured to said reinforced sole.

6. The garment of claim 1, said thickness being about 4 mils.

7. The garment of claim 1, said strap means being adhesively secured to said lowermost portions.

* * * * *

UNITED STATES PATENT AND TRADEMARK OFFICE

CERTIFICATE OF CORRECTION

PATENT NO. : 5,361,411

DATED : November 8, 1994

INVENTOR(S) : William W. Bohn, et al

It is certified that error appears in the above-indentified patent and that said Letters Patent is hereby corrected as shown below:

On the title page, item (73) should be added as follows:

--[73] Assignee: S&B Care, Inc.
Kansas City, Missouri--

On the title page, item (22), "Filed: May 8, 1992" should be changed to --PCT Filed: December 21, 1990--

On the title page, item (86) should be added as follows:

--[86] PCT NO.: PCT/US90/07625
§ 371 Date: May 8, 1992
§ 102(e) Date: May 8, 1992--

On the title page, item (87) should be added as follows:

--[87] PCT Pub. No.: WO 91/09545
PCT Pub. Date: July 11, 1991--

UNITED STATES PATENT AND TRADEMARK OFFICE

CERTIFICATE OF CORRECTION

PATENT NO. : 5,361,411

DATED : November 8, 1994

INVENTOR(S) : William W. Bohn, et al

It is certified that error appears in the above-indentified patent and that said Letters Patent is hereby corrected as shown below:

On the title page, item (63) should be added as follows:

--Related U.S. Application Data

[63] Continuation of Ser. No. 522,306, May 11, 1990, abandoned, which is a continuation of Ser. No. 455,088, December 22, 1989, abandoned.--

Signed and Sealed this

Sixteenth Day of September, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,361,411

DATED : November 8, 1994

INVENTOR(S) : William W. Bohn, et al

It is certified that error appears in the above-indentified patent and that said Letters Patent is hereby corrected as shown below:

On the title page, item (73) should be added as follows:

--[73] Assignee: S&B Care, Inc.
Kansas City, Missouri--

On the title page, item (22), "Filed: May 8, 1992" should be changed to --PCT Filed: December 21, 1990--

On the title page, item (86) should be added as follows:

--[86] PCT NO.: PCT/US90/07625
§ 371 Date: May 8, 1992
§ 102(e) Date: May 8, 1992--

On the title page, item (87) should be added as follows:

--[87] PCT Pub. No.: WO 91/09545
PCT Pub. Date: July 11, 1991--

UNITED STATES PATENT AND TRADEMARK OFFICE

CERTIFICATE OF CORRECTION

PATENT NO. : 5,361,411

DATED : November 8, 1994

INVENTOR(S) : William W. Bohn, et al

It is certified that error appears in the above-indentified patent and that said Letters Patent is hereby corrected as shown below:

On the title page, item (63) should be added as follows:

--Related U.S. Application Data

[63] Continuation of Ser. No. 522,306, May 11, 1990, abandoned, which is a continuation of Ser. No. 455,088, December 22, 1989, abandoned.--

Signed and Sealed this

Sixteenth Day of September, 1997

*Attest:*

Bruce Lehman

BRUCE LEHMAN

*Attesting Officer*

*Commissioner of Patents and Trademarks*